US006672396B1

(12) United States Patent
Marroquin et al.

(10) Patent No.: US 6,672,396 B1
(45) Date of Patent: Jan. 6, 2004

(54) SUBSEA WELL APPARATUS

(76) Inventors: Daniel A. Marroquin, 11426 Hambleton Way, Houston, TX (US) 77065; Flavio Nisenbaum, 8723 Cyrpressbrook, Houston, TX (US) 77095

( * ) Notice: Subject to any disclaimer, the term of this patent is extended or adjusted under 35 U.S.C. 154(b) by 0 days.

(21) Appl. No.: 10/176,305

(22) Filed: Jun. 20, 2002

(51) Int. Cl.[7] ..... E21B 29/12
(52) U.S. Cl. ..... 168/348; 368/359
(58) Field of Search ..... 166/348, 349, 166/345, 359, 368; 405/224; 285/10, 101, 920

(56) References Cited

U.S. PATENT DOCUMENTS

| | | | | |
|---|---|---|---|---|
| 4,499,950 A | | 2/1985 | Watkins | |
| 4,751,968 A | | 6/1988 | Ames et al. | |
| 5,029,647 A | | 7/1991 | Milberger et al. | |
| 5,066,048 A | | 11/1991 | Farrell | |
| 5,247,996 A | | 9/1993 | Milberger | |
| 5,273,117 A | * | 12/1993 | Reimert | 166/348 |
| 5,299,643 A | * | 4/1994 | Vetter et al. | 166/368 |
| 5,439,061 A | * | 8/1995 | Brammer et al. | 166/368 |
| 6,202,745 B1 | * | 3/2001 | Reimert et al. | 166/115 |
| 6,540,024 B2 | * | 4/2003 | Pallini et al. | 166/348 |
| 6,550,537 B1 | * | 4/2003 | Alvarez et al. | 166/348 |

* cited by examiner

*Primary Examiner*—Robert E. Pezzuto
*Assistant Examiner*—Thomas A. Beach
(74) *Attorney, Agent, or Firm*—Loren G. Helmreich; Browning Bushman, P.C.

(57) ABSTRACT

A subsea well apparatus includes a wellhead member body adapted to be lowered into and latched within the bore of a conductor by split locking and ratchet rings carried by the body. The locking ring includes locking teeth engageable with locking grooves in the bore, and the ratchet ring includes ratchet teeth engageable with ratchet grooves within the locking ring. Upper and lower coaxial downwardly and inwardly extending wedge surfaces are tightly engaged as the body is latched within the conductor.

15 Claims, 10 Drawing Sheets

SUBSEA WELL APPARATUS

This invention relates generally to subsea well apparatus of the type in which a wellhead member body is adapted to be lowered into and latched within the bore of a conductor which is mounted on the ocean floor, following which a riser is connected to the upper end of the body for extension upwardly to a drilling vessel. More particularly, it relates to improvements in apparatus of this type in which the wellhead member body is "weight set" in the sense that it is latched in the bore of the conductor in response to its own weight, thus avoiding the need for special running and setting tools for that purpose.

Since the riser is subject to wave and wind action, it is bent with respect to the subsea well, thus imposing bending forces on the latch and causing resulting fatigue. Various efforts have been made to stabilize latching of the wellhead member body within the conductor bore. For example, in accordance with U.S. Pat. No. 5,029,647, the wellhead member body has upper and lower downwardly and inwardly tapering wedge surfaces which are tightly received within coaxial upper and lower downwardly and inwardly tapered wedge surfaces on the conductor bore as the wellhead member is lowered and latched within the conductor by upwardly facing ratchet teeth on the conductor engageable with ratchet grooves on the body.

One problem with such apparatus is that the upper wedge surface on the conductor bore is subject to damage as tools are lowered through it. Also, there is inherently a certain amount of "play" between the ratchet teeth and grooves which adds to the possibility of fatigue.

It is the object of this invention to provide such apparatus in which the upper wedge surface in the conductor bore is protected as tools are lowered through it and, more particularly in which, the body is latched with the bore in a manner which minimizes the possibility of vertical or radial movement responsive to the aforementioned forces. A more particular object is to provide such apparatus in which the latch may be easily released to permit retrieval of the body from the conductor.

These and other objects are accomplished, in accordance with illustrated and preferred embodiment of the invention, by subsea well apparatus which includes a conductor having a vertical bore therethrough, locking grooves within the bore, and a lower downwardly and inwardly tapered wedge surface within the bore beneath the grooves, and a wellhead member body which is lowerable into the bore of the conductor and which has, about its outer side, an upwardly facing seat, a recess above the seat, a lower downwardly and inwardly tapered wedge surface below the seat in the conductor bore, and an upper downwardly and inwardly tapered wedge surface between the recess and seat.

A normally contracted, split locking ring is supported on the seat and has, about its outer side, locking teeth disposable opposite the locking grooves, as the body is lowered into the conductor bore, ratchet grooves about its inner side, and an upper downwardly and inwardly tapered wedge surface beneath the ratchet grooves. A normally expanded split ratchet ring which is slidable inwardly and outwardly within the recess above the locking ring has latching teeth about its outer side, and is positioned to land on the upper end of the locking ring upon initial lowering of the body.

Upon further lowering of the body, the ratchet ring forces the locking ring and its teeth outwardly toward the locking grooves and disposes the ratchet teeth opposite the ratchet grooves. Upon still further lowering of the body, the ratchet ring forces the locking teeth into locking engagement with the locking grooves and the ratchet teeth of the ratchet ring into locking engagement with the ratchet grooves of the locking ring, as the upper wedge surface about the body tightly engages upper wedge surface on the inner side of the locking ring, and the lower wedge surface about the body tightly engages the lower wedge surface in the conductor bore. The upper and lower wedge surfaces are coaxial and extend at a relatively small angle with respect to the vertical.

The ratchet ring has a surface slidable downwardly and outwardly over a surface of the body, and the locking ring has a surface slidable upwardly and outwardly over a surface of the conductor bore, as the wedge surfaces are tightly engaged. More particularly, the first mentioned surfaces form a larger angle with respect to the horizontal than the second mentioned surfaces, so as to urge the rings outwardly with a radial component of force, thereby minimizing the possibility of gaps in the latch which might otherwise permit play leading to the possibility of fatigue.

The upper end of the locking ring extends above the conductor when the latch is set, and carries bolts for movement inwardly to force the ratchet ring into the recess and thus release its ratchet teeth from the ratchet grooves in the locking ring. Thus, the locking ring teeth are free to retract from the grooves in the conductor body to permit the rings to be raised with the body from the conductor bore.

The bore of the conductor has a reduced diameter portion beneath the first shoulder through which an enlarged portion of the body beneath the seat is guidably passed as the body is lowered, and fluid bypass slots extend vertically through one of the portions.

A normally expanded split retainer ring supported on the seat is connected to the lower end of the locking ring for expansion and contraction with respect thereto, and is releasable from the locking ring but held on the seat, as the body is initially lowered, and then reconnected to the locking ring, upon raising of the body.

In the drawings, wherein like reference characters are used throughout to designate like parts:

FIGS. 1 to 5 are vertical sectional views of a preferred embodiment of the above described apparatus, wherein FIG. 1 shows the wellhead assembly body as it is lowered into an initial position in the bore of the conductor to land the retainer ring at the lower end of the lock ring on an upwardly facing seat in the bore of the conductor so as to dispose the locking teeth of the locking ring opposite the locking grooves in the bore of the conductor, FIG. 2 shows the wellhead housing body lowered from the position of FIG. 1 so as to release the retainer ring from the lock ring and permit the ratchet ring to land on the upper end of the locking ring and lower as the locking ring lands onto a shoulder in the conductor bore above the locking grooves;

FIG. 3 shows the apparatus upon further lowering of the wellhead assembly body to cause the ratchet ring to force the locking ring outwardly to move its locking teeth toward the locking grooves;

FIG. 4 shows the apparatus upon still further lowering of the wellhead housing body so as to lower its upper wedge surface into the wedge surface of the locking ring and its lower wedge surface into the lower wedge surface of the conductor, and force the locking teeth about the lock ring toward locking engagement with the locking grooves in the bore of the conductor and lower the ratchet ring a position in which its ratchet teeth are opposite the ratchet grooves of the locking ring;

FIG. 5A is a detailed sectional view of the encircled view of the apparatus shown in FIG. 5, upon further lowering of the body to close the gap;

Figure 1:
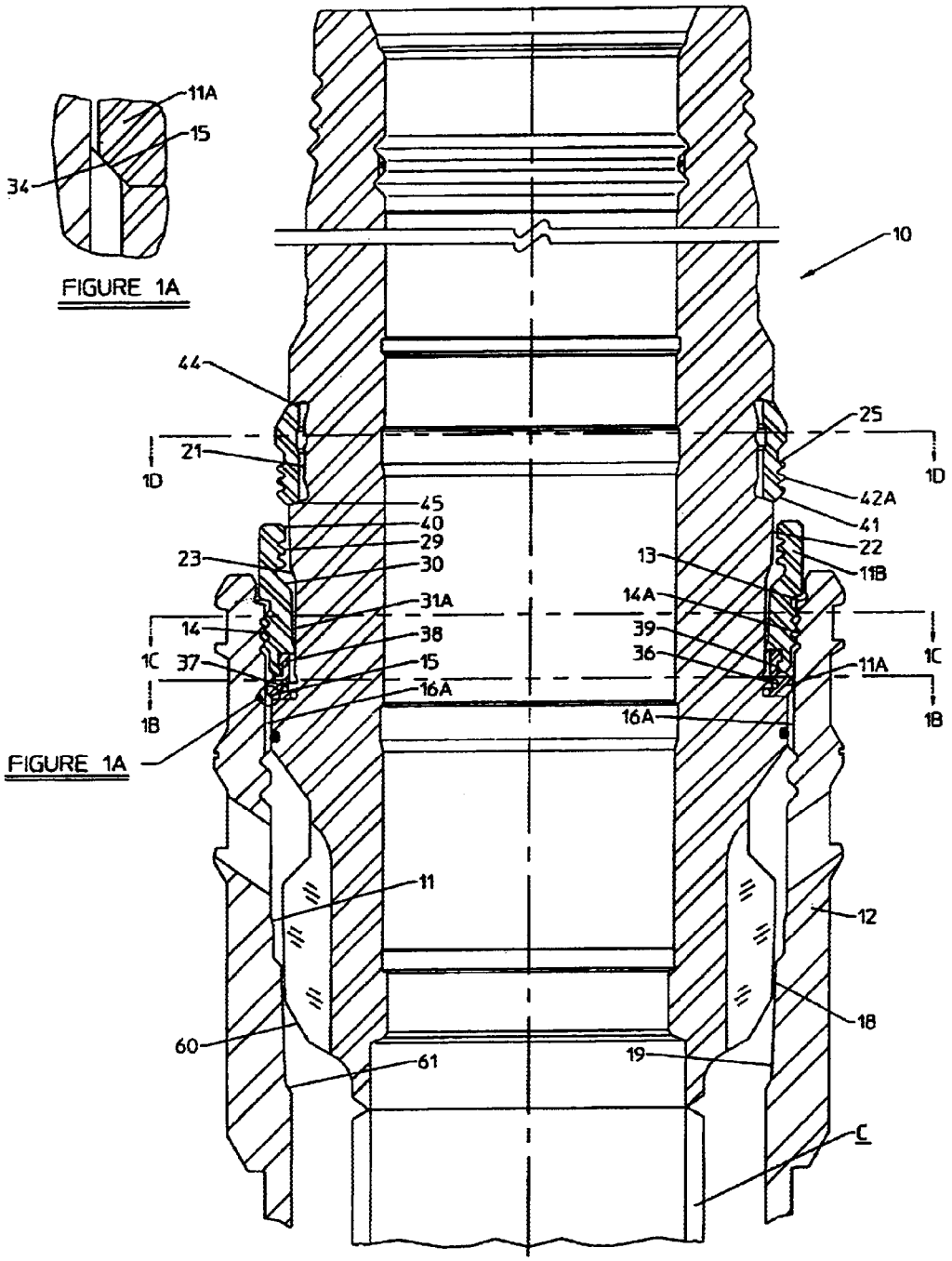
FIG. 1A is an enlarged detailed view of the portion of the apparatus circled in FIG. 1 wherein the retainer ring has landed on the shoulder in the conductor bore.
Figure 1B:
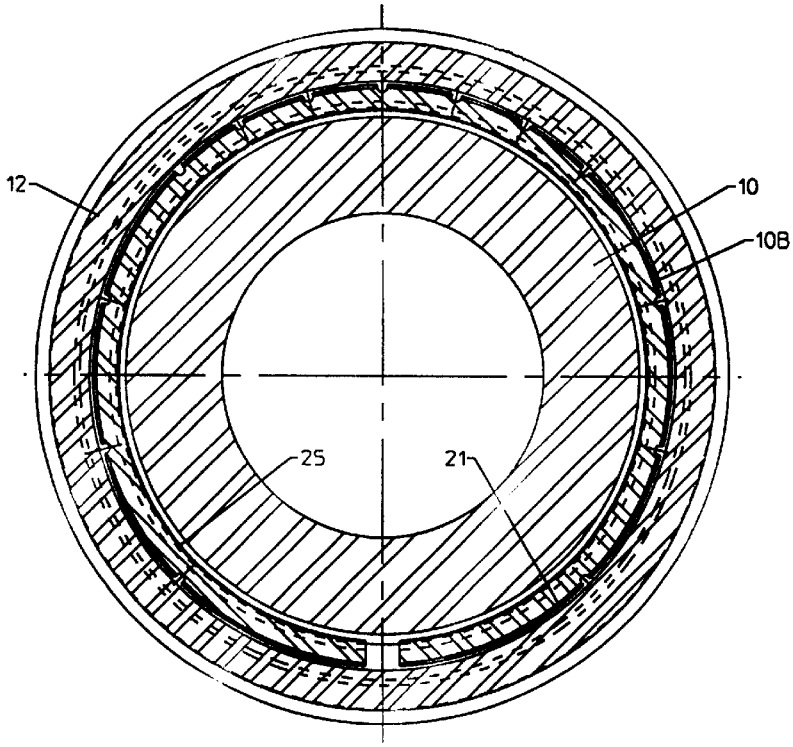
Figure 1C:
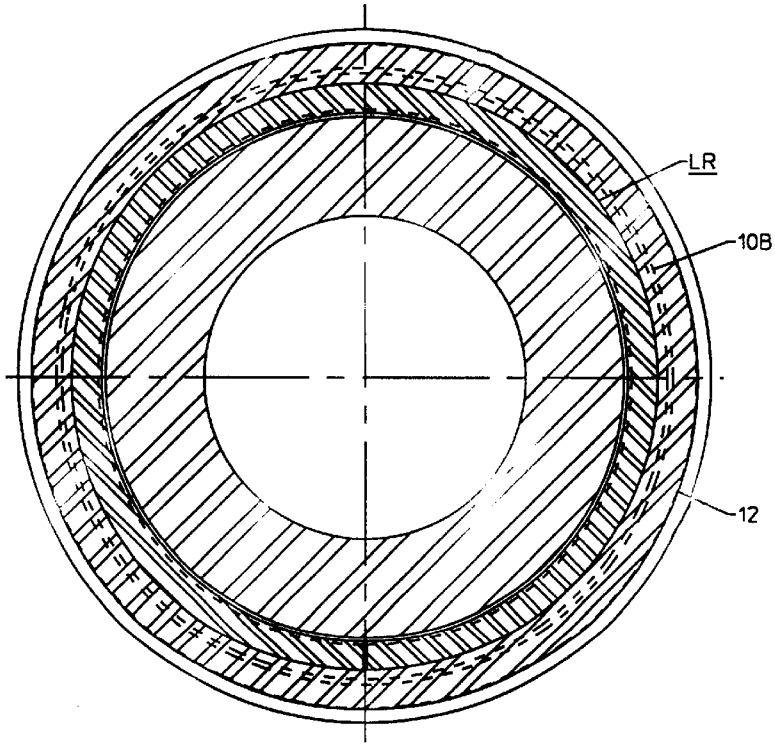
Figure 1D:
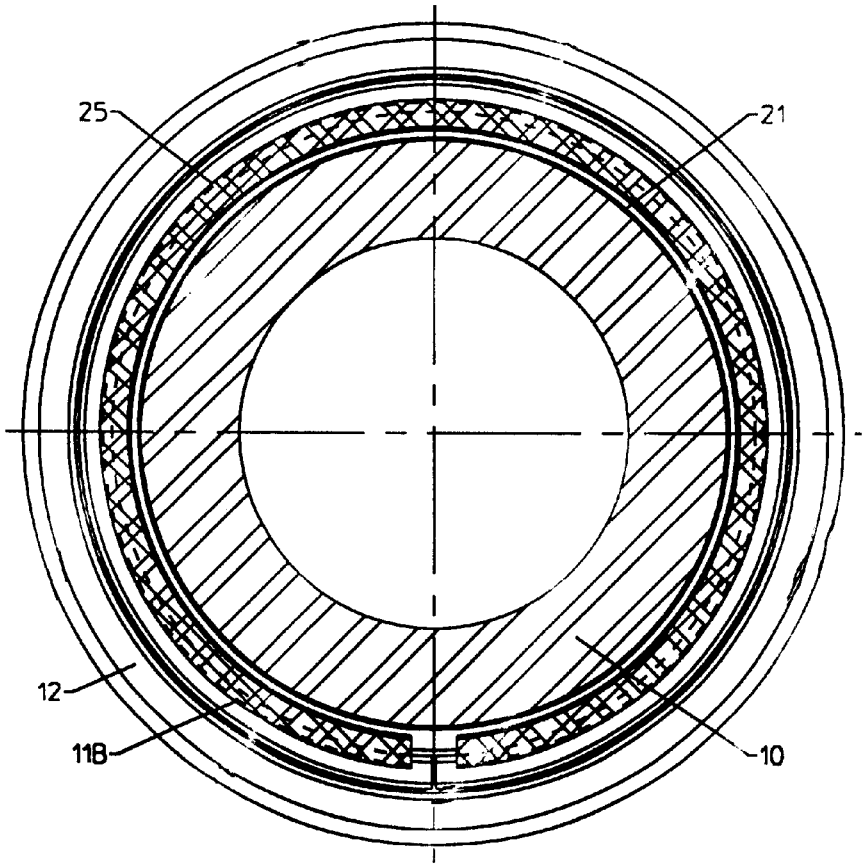

With reference now to the details of the above described drawings, and particularly FIGS. 1 and 1A, a wellhead housing 10 welded to the upper end of a casing C is shown as it is initially lowered into the bore 11 of the conductor 12 to a position to land the retainer ring 11A at the lower end of the lock ring 11B to dispose a shoulder 12A about the ring above a downwardly and inwardly tapered shoulder 13 in the upper end of the conductor bore. This locates locking teeth 14 about a normally expanded lock ring LR opposite locking grooves 14A in the bore above a downwardly and inwardly tapered shoulder 15 at the upper end of a restriction 16 in the bore. Vertical slots 16A in the restriction provide fluid bypasses during lowering of an enlarged portion of the wellhead housing body therethrough. The wellhead housing body has a lower downwardly and inwardly tapered lower wedge surface 18 for sliding downwardly within a coaxial lower downwardly and inwardly tapered wedge surface 19 in the bore of the conductor.

The outer side of the body has a recess 21 formed thereabout above an upper downwardly and inwardly tapered wedge surface 22, which in turn is disposed above downwardly and inwardly tapered shoulder 23. The upper and lower ends of the recess are parallel and taper downwardly and inwardly to receive a normally expanded split ratchet ring 25.

Figure 3:
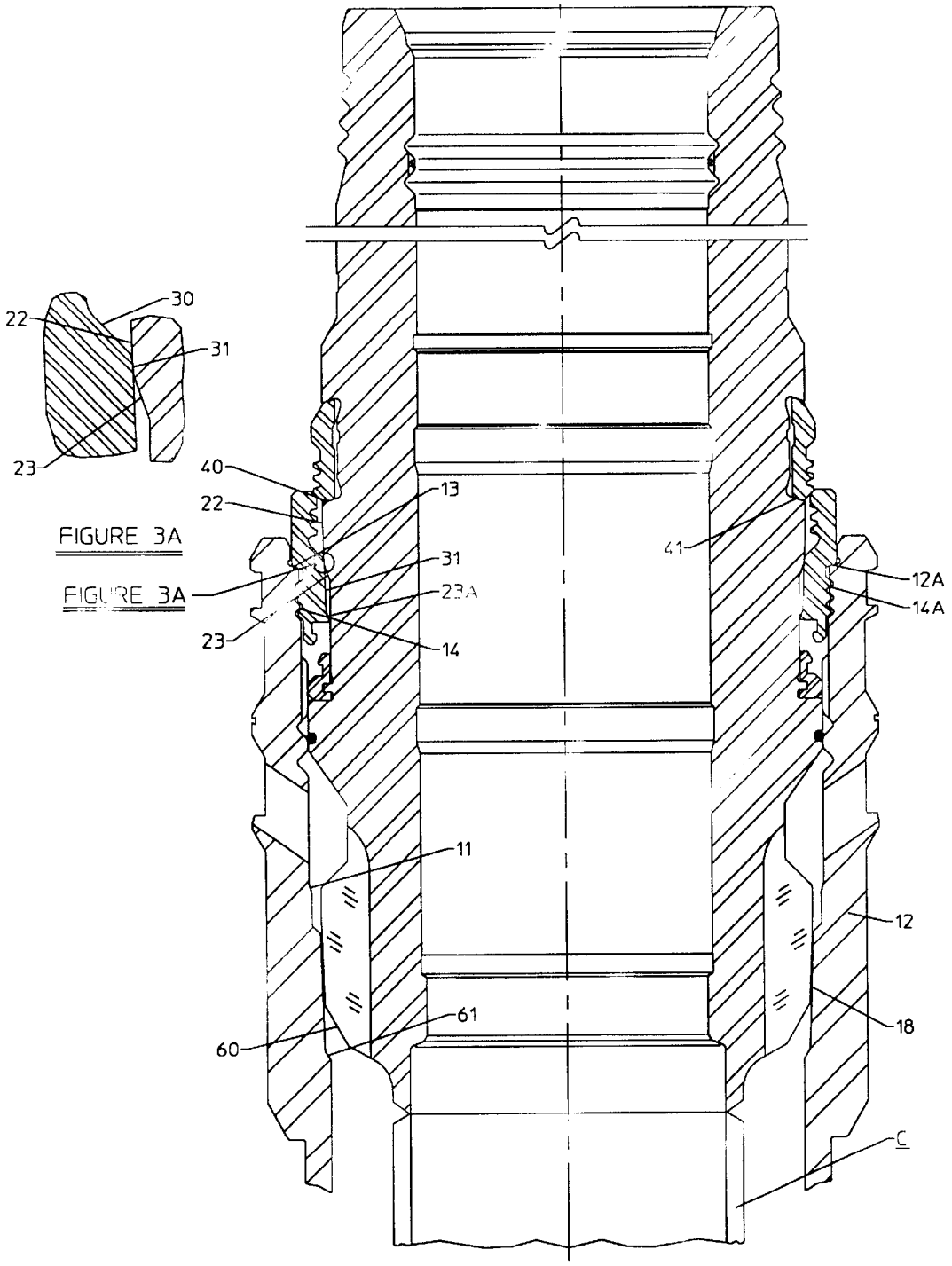
FIG. 3A is an enlarged detailed view of the encircled portion of FIG. 3 where in the upper wedge surfaces about the body has moved downwardly within the upper wedge surface within the lock ring.

The normally contracted split lock ring LR carried about the body has, in addition to locking teeth 14 formed thereabout beneath downwardly facing shoulder 12A, ratchet grooves 29 formed about its inner side beneath its upper end. The inner side of the locking ring also has a downwardly and inwardly tapered shoulder 30 beneath its ratchet grooves 29. A downwardly and inwardly extending tapered wedge surface 31 is formed on the inner side of the lock ring beneath the shoulder 30 and thus in position to tightly receive the upper downwardly and inwardly tapered wedge surface 22 about the body during lowering of the body; and a downwardly and inwardly tapered shoulder 23A above shoulder 23 in position to land thereon following tight engagement of the upper wedge surfaces, as shown in FIGS. 3 and 3A.

As best shown in FIG. 1A, a normally contracted split retainer ring 11A has an annular groove 36 about its inner diameter which fits over a rib 37 about the outer side of the body and thus is releasably connected to the lower end of the lock ring and a downwardly and inwardly tapered shoulder to engage the downwardly and inwardly extending shoulder 15 in the conductor bore when the wellhead assembly body has been lowered to its initially supported position of FIG. 1. The outer side of the retainer ring has a groove 38 formed thereabout which, as shown in FIG. 1, fits over a inwardly extending flange 39 on the lower end of the lock ring, thus enabling the retainer ring to be carried on the lower end of the lock ring during initial lowering of the body.

As shown in FIG. 1, the locking ring LR is retained by ring 11A in a position in which an upwardly facing shoulder 40 thereabout is beneath the downwardly facing shoulder 41 about the ratchet ring 25. At this time, the locking ring occupies a normally contracted position so that its locking teeth are removed from locking engagement with the locking grooves about the bore of the conductor.

The upper and lower ends 44 and 45 of the ratchet ring are tapered downwardly and outwardly for sliding downwardly and outwardly within similarly tapered upper and lower ends of the recess 21. The downwardly and inwardly tapered shoulder 41 on the lower end of the ratchet ring is, in this initial position of FIG. 1, disposed above the downwardly and inwardly tapered shoulder 40 about the inner side of the lock ring. Thus, as the wellhead assembly is lowered from the position of FIG. 1 to that of FIG. 2, the shoulder 41 has moved downwardly into engagement with the upwardly facing shoulder 40 about the inner side of the locking ring, all of which is shown in more detail in FIG. 2A.

Figure 2:
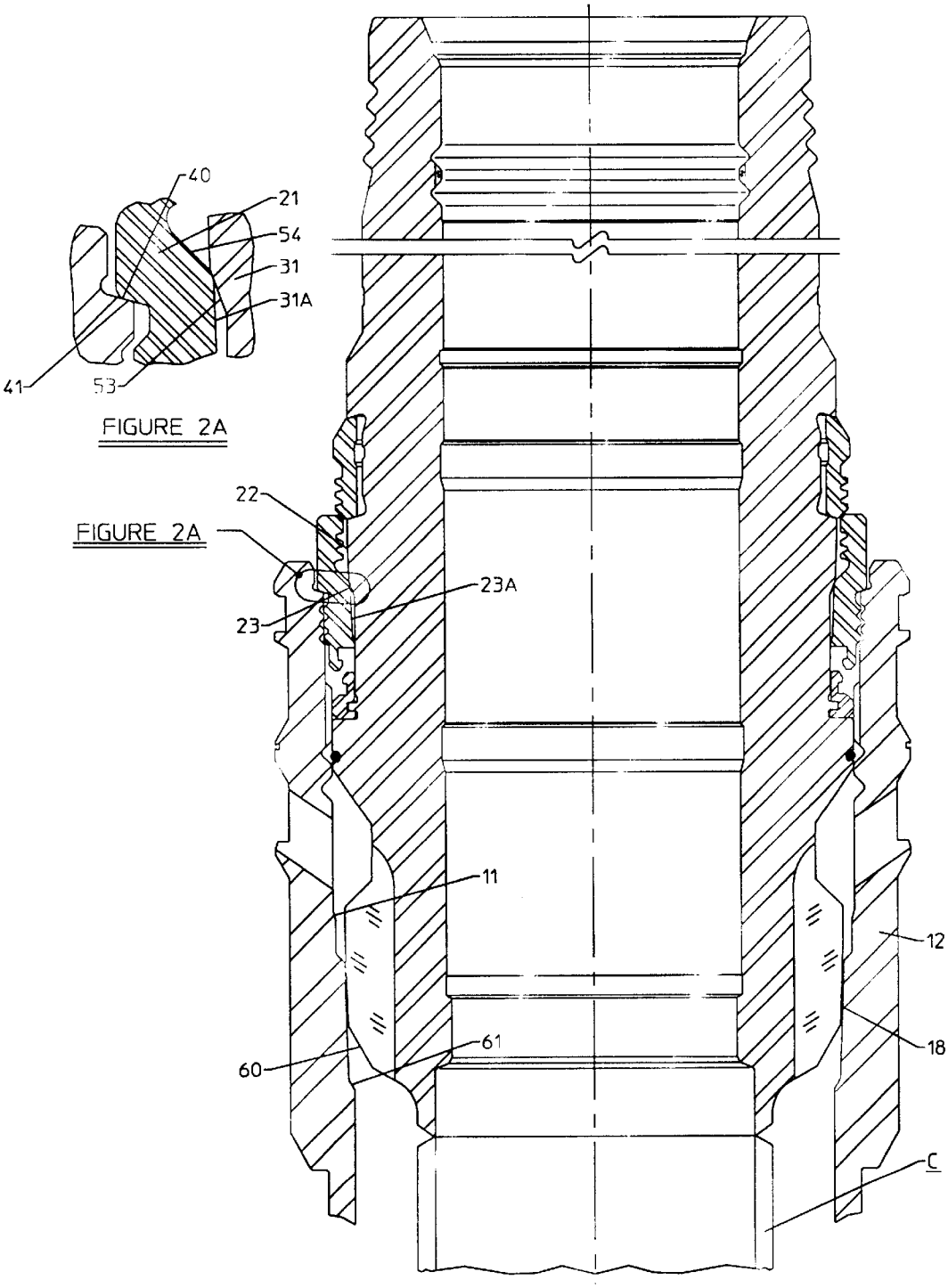
FIG. 2A is an enlarged detailed view of the apparatus circled in FIG. 2 wherein the ratchet ring has been lowered onto the locking ring, and a shoulder about the lock ring landed on an upper shoulder in the conductor bore.

Further downward movement of the wellhead assembly to the position of FIG. 2 has cammed the retainer ring inwardly so as to release it from, the lock ring; and thereby permit the body of the wellhead assembly to be lowered to the position of FIG. 2.

As shown in FIG. 3, further lowering of the body of the wellhead assembly body will cause the downwardly facing shoulder 41 about the ratchet ring to engage the shoulder 40 of the locking ring so as to cam it outwardly into a position in which the locking teeth 14A have moved toward the locking grooves 14 about the bore of the conductor. During this time, the downwardly facing shoulder 12A about the locking ring has been lowered toward the upwardly facing shoulder 13 of the conductor bore.

As the body of the wellhead assembly body is lowered to the FIG. 3 position, the lower edge of the upper wedge surface 22 thereabout has moved downwardly into the upper end of the upper wedge surface 31 within the lock ring substantially simultaneously with movement of the lower wedge surface 18 about the body into the coaxial lower wedge surface 19 within the bore of the conductor.

Figure 4:
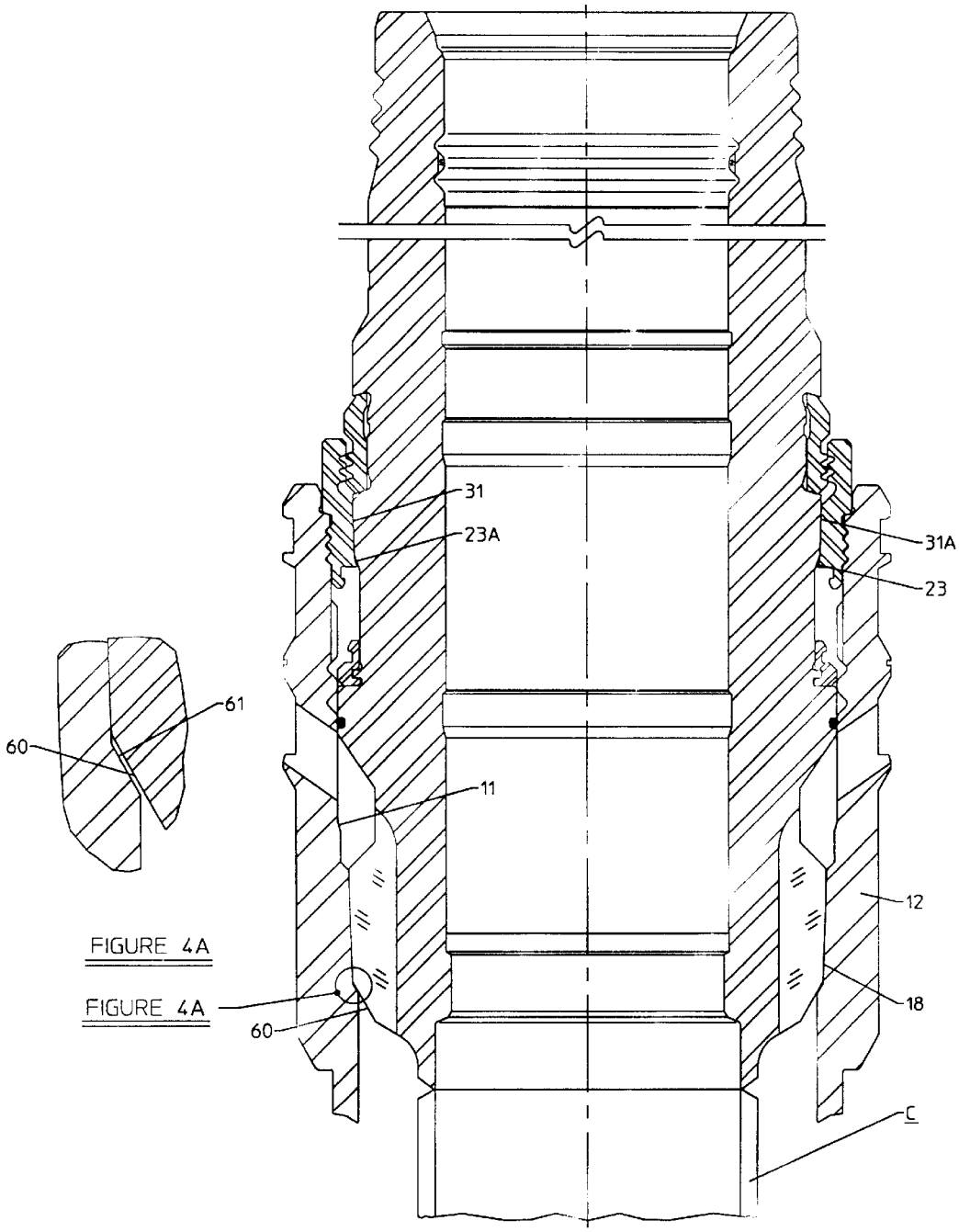
FIG. 4A is an enlarged view of the encircled portion of FIG. 4, showing a small vertical gap between a shoulder on the lower wedge surface of the wellhead housing body and a stop shoulder on the bore of the conductor following lowering further lowering of the body.

During continued downward movement to the FIG. 4 position, the lower end 41 of the ratchet ring has moved downwardly and inwardly over the shoulder 40 on the upper end of the locking ring so as to force the locking ring to a position in which its teeth 14 are disposed within the locking groove 14A about the bore of the conductor. This initial outward movement of the locking ring is permitted by radial spacing between the locking ring and the upper enlarged end of the bore.

As illustrated in FIG. 4, still further lowering of the body of the wellhead housing moves its tapered shoulder 23 onto shoulder 23A of the locking ring and the upper wedge surface 31A downwardly and inwardly into tight engagement with the wedge surface 31 on the lock ring, as the locking teeth of the locking ring further outwardly into the locking engagement with locking grooves in the bore of the conductor. This, of course, is made possible by the radial spacing or clearance between the outside of the locking ring and the upper end of the conductor (as shown in FIG. 3).

At the same time, the lower wedge surface 18 about the body has moved downwardly and inwardly into the outer wedge surface to a position, as best shown in 4A, in which there is a small vertical clearance or gap 60 between the lower end of the body and the shoulder 61 on the conductor bore.

At this point, the weight of the casing is slacked off to permit further downward movement to close the gap (see FIG. 5A) and dispose the ratchet teeth of the ratchet ring in ratcheting engagement with ratchet grooves on the inner side of the locking ring. This outward expansion of the ratchet ring is facilitated of course by the downwardly and outwardly tapered surface on its end slidable within the downwardly and inwardly extending lower end of the groove.

Figure 5:
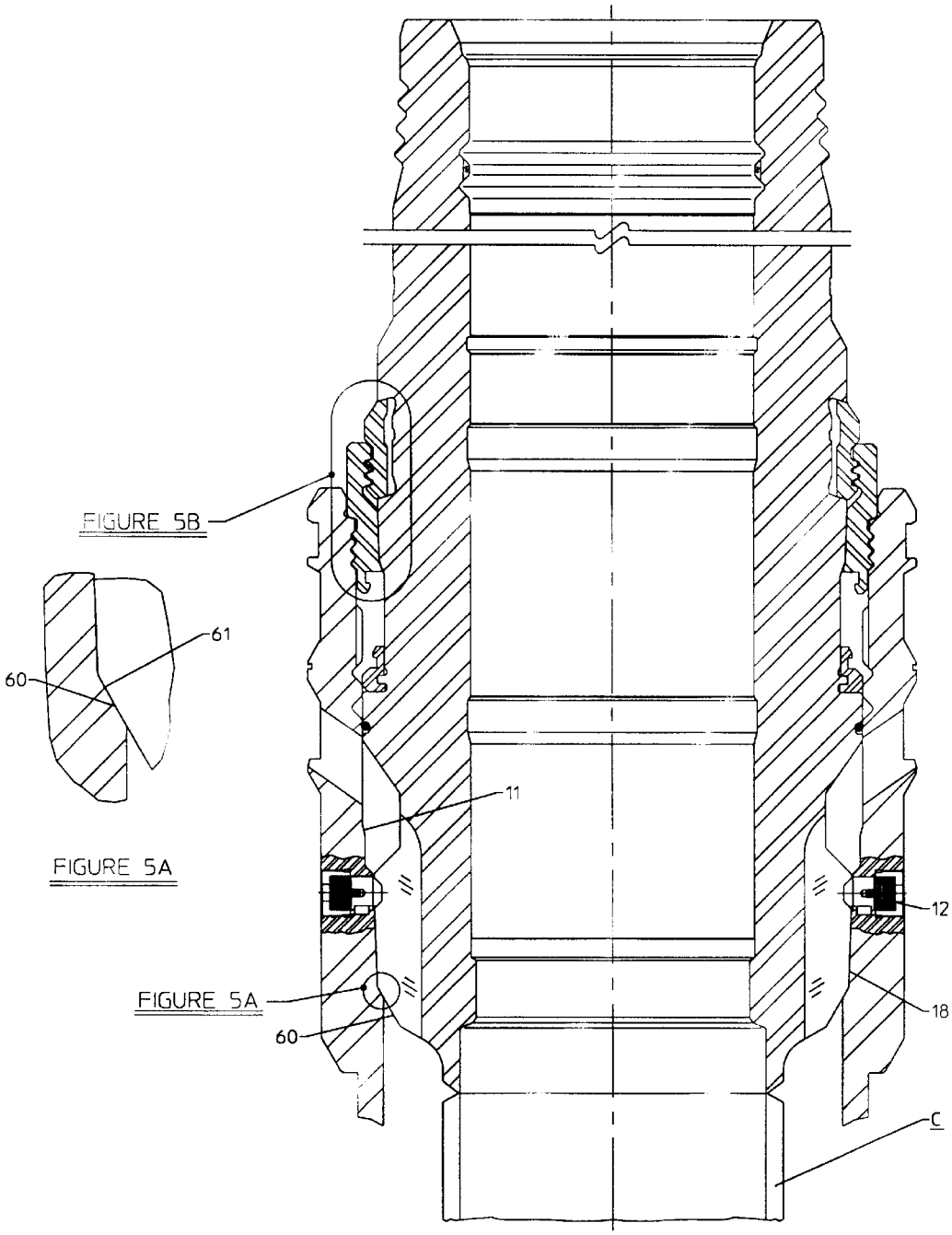
FIG. 5 shows the final lowering of body so as to cause the upper and lower wedge surfaces to tightly engage and the body and the ratchet ring to be cammed outwardly within its recess to cause its ratchet teeth to ratchet over the ratchet grooves of the lock ring and thereby latch the body to the conductor.

As best shown in FIG. 5 during this lowering of the body to the position of FIG. 5, the ratchet ring moves radially outwardly to cause the upper flanks of its teeth to tightly engage with the lower flanks of the ratchet grooves on the inner side of the lock ring. In this final landed position of the body within the conductor, the locking ring has moved into tight locking position within the conductor as shoulder 41 slides outwardly over the upwardly facing shoulder 40 on the inside of the lock ring.

Figure 5B:
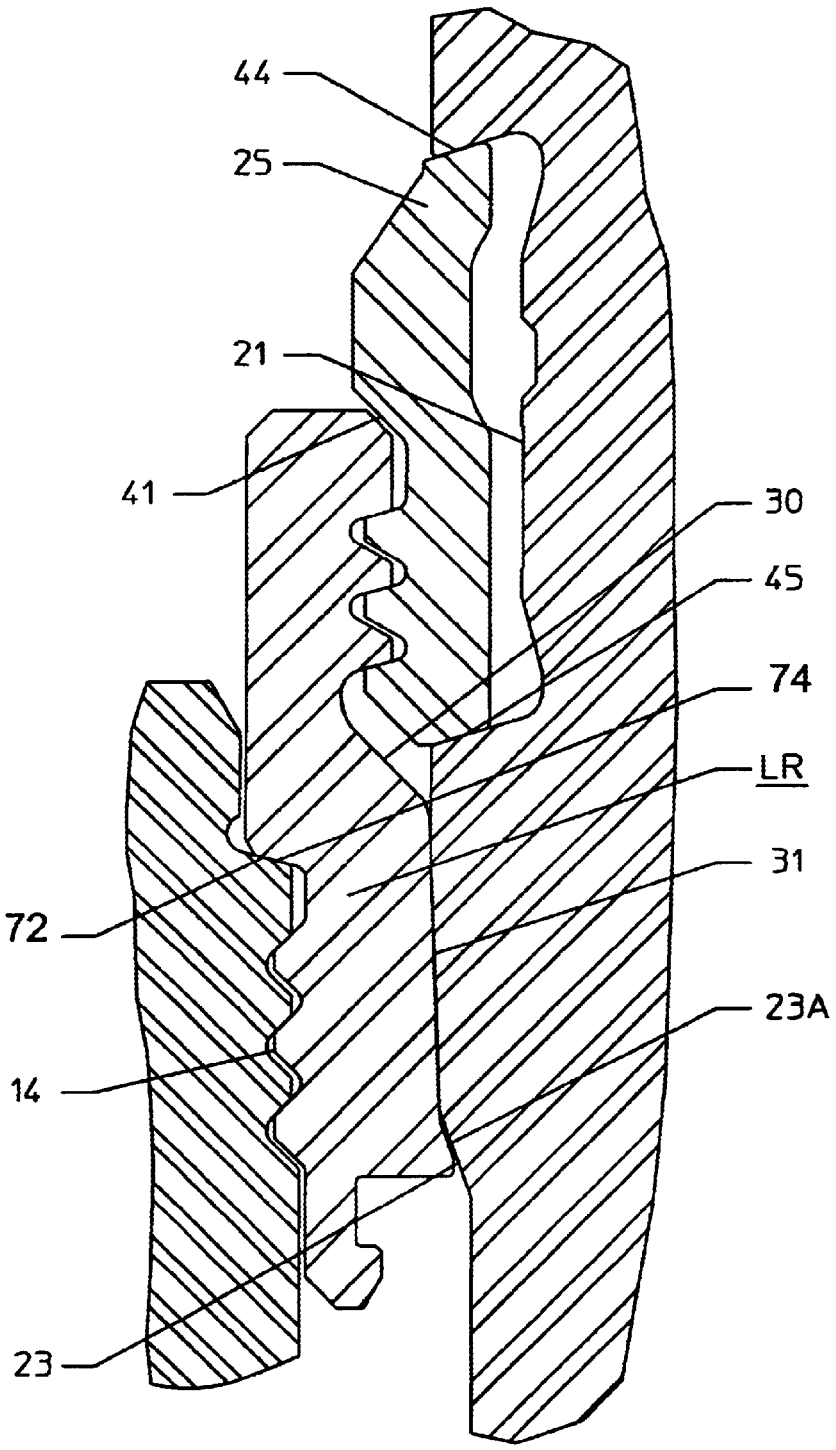
FIG. 5B is an enlarged detailed sectional view showing the interengagement of the body, ratchet ring, locking ring and locking recess in the conductor bore upon lowering of the body to the latched position of FIG. 5, and FIGS. 1B, 1C and 1D are horizontal sectional views of the apparatus as seen along broken lines 1B, 1C and 1D.

As shown in FIG. 5B, the engaged shoulder 72 on the lower end of the locking ring and the shoulder 74 in the bore of the conductor extend at an angle of about 15 degrees with respect to the horizontal. Similarly, the shoulders 72 and 74 as well as the upper flanks of the ratchet teeth of the ratchet ring form an angle of about 15 degrees with respect to the lower flanks of the ratchet grooves of the locking ring. However, the engaged lower ends 46 of the ratchet ring and recess 21 in which it is disposed form an angle of about 17 degrees, and in any event greater than 15 degrees.

Thus, the ratchet ring is urged outwardly into engagement with the locking ring with a radial component of force greater than the inward components of force between the conductor bore and the locking ring, as well as those between the ratchet teeth and grooves. Thus, any motion between the conductor, locking ring and ratchet ring with respect to the conductor housing will not only prevent inward movement, but cause further outward movement to eliminate any gap between them.

As also previously described, the engagement of the axially aligned upper and lower wedge surfaces will resist bending of the wellhead housing body above the conductor, and particularly of the riser string extending upwardly to the surface whose bending which might otherwise cause fatigue of the engaged parts locking the body within the conductor.

Figure 6:
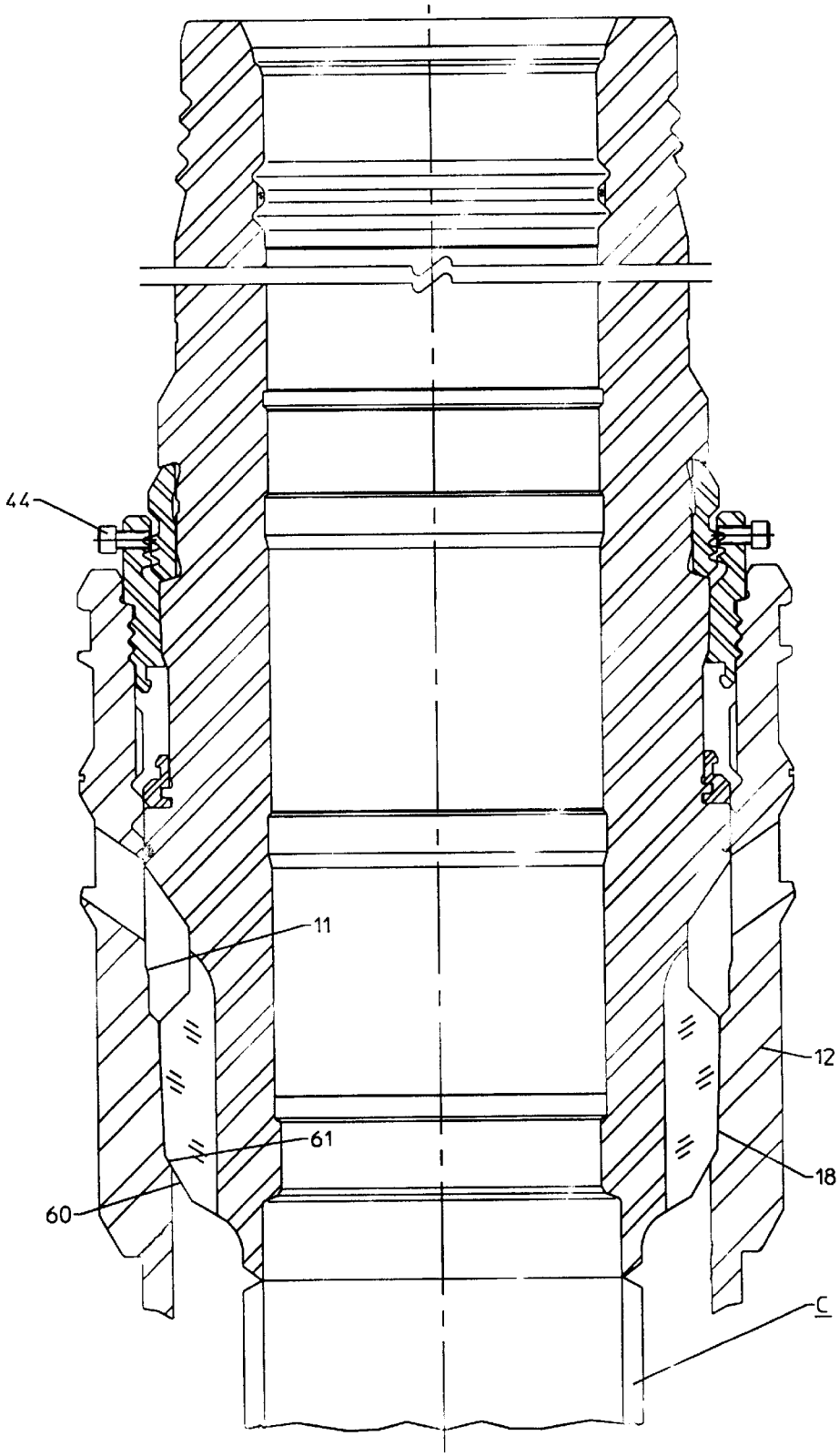
FIG. 6 is still another view of the apparatus similar to FIG. 5, but wherein bolts threadedly mounted on the locking ring have been moved radially inwardly to force the ratchet ring into its recess and thus move the ratchet teeth out of engagement with the ratchet grooves of the locking ring.
Figure 7:
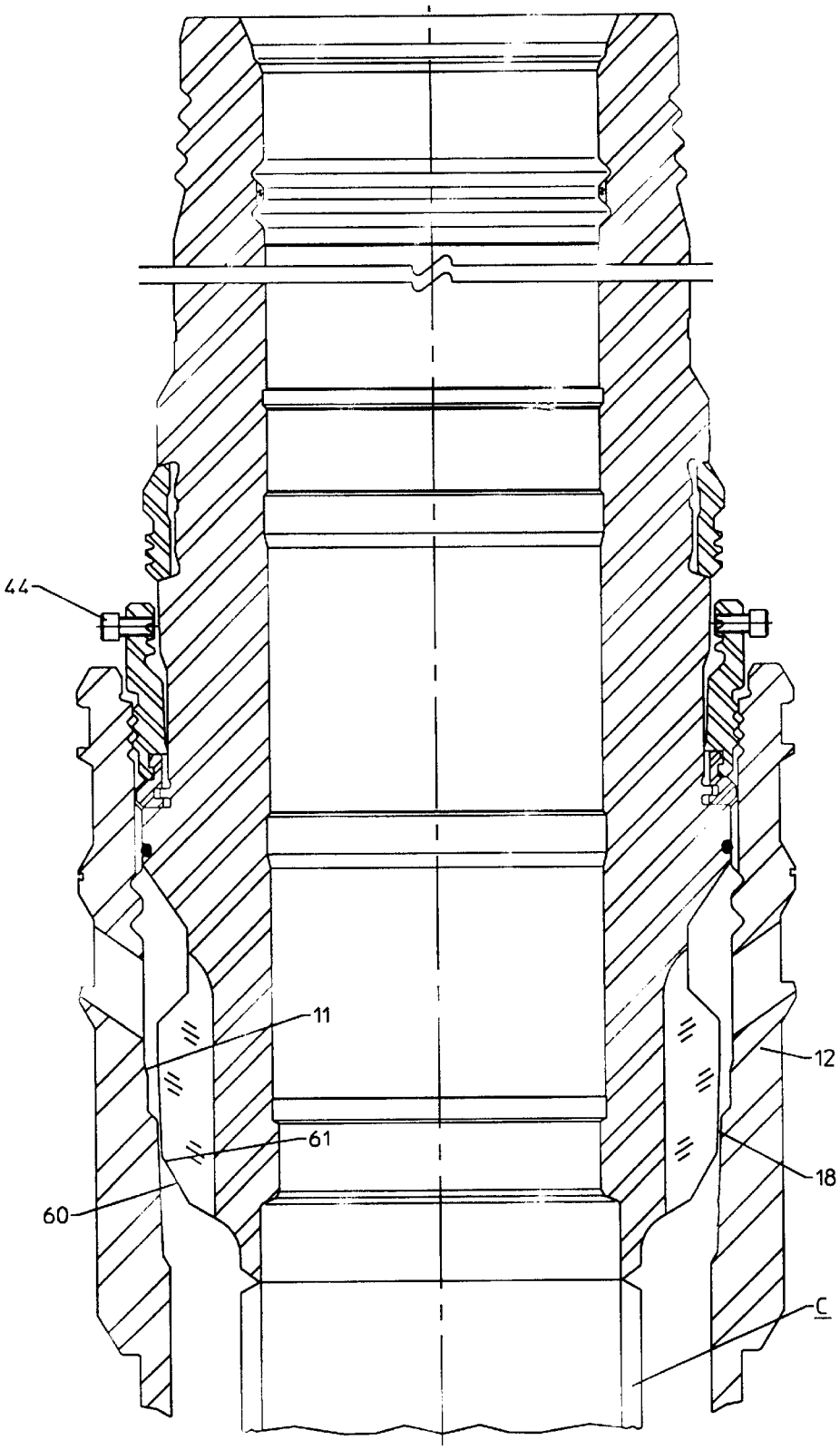
FIG. 7 is yet another view of the apparatus wherein raising of the ratchet ring with the body from within the locking ring to permit the lock ring to contract out of the locking grooves and the retainer ring to be reconnected with the lower end of the locking ring, so that the wellhead assembly body, the ratchet ring, locking ring and retainer ring may be raised from within the conductor.

As shown in FIG. 6 a series of screws 44 are threadedly received in holes through the upper portion of the locking ring for engaging the ratchet ring as the bolts moved outwardly. This will force the ratchet ring inwardly within its recess to release the latching teeth from the latching grooves of the locking ring to permit the locking ring to move to its normally contracted position (FIG. 7) in which its teeth are removed from the locking grooves within the bore of the conductor. Thus, the rings may be lifted with the retainer ring as the body is raised with the body from within the conductor.

Various other modifications to the apparatus disclosed herein should be apparent from the above description of preferred embodiment. Although the invention has thus been described in detail for this embodiment, it should be understood that this explanation is for illustration, and that the invention is not limited to this embodiment.

What is claimed is:

1. A subsea well apparatus, comprising:

a conductor having a bore therethrough with locking grooves about the bore;

a wellhead body adapted to be lowered into the bore for landing therein;

a split lock ring carried by the body and having latching lock ring teeth for disposal opposite the grooves as the body is so lowered, and having ratchet ring grooves therein;

a split ratchet ring carried by the body for disposal above the locking ring and having latching ratchet ring teeth thereabout;

said ratchet ring engaging the lock ring, upon initial lowering of the body, so as to force the lock ring teeth into the locking grooves, and, upon further lowering thereof, causing the ratchet ring teeth to engage the ratchet ring grooves;

a lower downwardly and inwardly extending wedge surface about the conductor bore;

an upper downwardly and inwardly extending wedge surface within the locking ring; and upper and lower downwardly and inwardly extending wedge surface about the body;

said upper and lower wedge surfaces being coaxial and extending at a relatively small angle with respect to the vertical to tightly engage one another as the ratchet ring teeth engage the ratchet ring grooves.

2. A subsea well apparatus as recited in claim 1, wherein relatively slidable surfaces of the ratchet ring and body, the locking ring and body, and the locking and ratchet ring are so arranged that the weight of the body urges the rings outwardly with a radial component of force.

3. A subsea well apparatus as recited in claim 1, wherein the upper end of the locking ring extends above the conductor and carries bolts for movement inwardly to force the ratchet ring into the recess and thus release its ratchet teeth from the ratchet grooves in the locking ring to permit the locking ring teeth to retract from the grooves in the conductor body, so that the rings may be raised with the body from the conductor bore.

4. A subsea well apparatus, comprising:

a conductor having a vertical bore therethrough, locking grooves within the bore, an upwardly facing shoulder within the bore beneath the grooves, and a lower downwardly and inwardly tapered wedge surface within the bore beneath the shoulder;

a wellhead member body lowerable into the bore of the conductor and having, about its outer side, a recess, an upper downwardly and inwardly extending wedge surface beneath the recess, an upwardly facing seat beneath the wedge surface, and a lower downwardly and inwardly extending wedge surface below the seat;

a normally contracted, split locking ring supported on the seat and having, about its outer side, locking teeth opposite the locking grooves, and, about its inner side, ratchet grooves, and an upper downwardly and inwardly extending wedge surface beneath the ratchet grooves;

a normally expanded, split ratchet ring disposed within and having upper and lower ends slidable inwardly and outwardly in the recess, and upwardly facing ratchet teeth about its outer side;

said ratchet ring being landable on the locking ring to lower the locking ring to a position in which its locking teeth are opposite the locking grooves, and, upon continued lowering of the body, forces the teeth of the locking ring outwardly into locking engagement with the locking grooves and the ratchet teeth of the ratchet ring into engagement with the ratchet grooves of the locking ring, as the lower wedge surface about the body slides into the lower wedge surface in the conductor bore and the upper wedge surface about the body slides into the upper wedge surface of the locking ring; and the wedge surfaces extending at a relatively small angle with respect to the vertical, and the upper wedge surfaces being coaxial with the lower wedge surfaces.

5. A subsea well apparatus as recited in claim 4, wherein the ratchet ring and body, the locking ring and body, and the locking and ratchet ring having relatively slidable surfaces so arranged that the weight of the body urges the rings outwardly with a radial component of force.

6. A subsea well apparatus as recited in claim 4, wherein the upper end of the locking ring extends above the conductor and carries bolts for movement inwardly to force the ratchet ring into the recess and thus disengage its ratchet teeth from the ratchet grooves in the locking ring to permit the locking ring teeth to disengage from the grooves in the conductor body, so that the rings may be raised with the body from the conductor bore.

7. A subsea well apparatus as recited in claim 4, wherein the bore of the conductor has a reduced diameter portion beneath its shoulder through which an enlarged portion of the body beneath the seat is guidably passed as the body is lowered; and fluid bypass slots extend vertically through one of the portions.

8. A subsea well apparatus as recited in claim 4, further comprising:

a normally expanded retainer ring supported on the body seat and connected to the lower end of the locking ring for expansion and contraction with respect thereto and upon lowering of the body as forced by the shoulder in the bore to contract to be released prior to the lock ring, but, upon raising of the body to expand for reconnecting with the lock ring and thus retrieval with the body.

9. A subsea well apparatus, comprising:

a conductor having a vertical bore therethrough, locking grooves within the bore, an upwardly facing shoulder within the bore beneath the grooves, and a lower downwardly and inwardly tapered wedge surface within the bore beneath the shoulder, a wellhead member body lowerable into the bore of the conductor and having, about its outer side, a recess, an upper downwardly and inwardly tapered wedge surface beneath the recess, a downwardly and inwardly tapered shoulder beneath the upper wedge surface, an upwardly facing seat beneath the shoulder, and a lower downwardly and inwardly tapered wedge surface beneath the seat, a normally contracted, split locking ring supported above the seat and having, about its outer side, a downwardly and inwardly tapered shoulder disposed above the shoulder on the conductor bore and locking teeth beneath the shoulder and opposite the locking grooves, and having, about its inner side, ratchet grooves, a downwardly and inwardly extending shoulder above the grooves, an upper downwardly and inwardly tapered wedge surface beneath the ratchet grooves, and a downwardly and inwardly tapered shoulder beneath the wedge surface, a normally expanded ratchet ring having upper and lower ends slidable inwardly and outwardly in the recess and having ratchet teeth about its outer side, said ratchet teeth being landable on the locking ring, upon initial lowering of the body, so that, upon further lowering, the ratchet ring will force the locking ring downwardly to land its shoulder on the shoulder in the conductor bore, and then lower the locking ring to dispose its locking teeth opposite the locking grooves as the lower wedge surface of the body slides within the lower wedge surface in the conductor bore, and thus, upon continued lowering, force the teeth of the locking ring outwardly toward the locking grooves and dispose the ratchet teeth above the ratchet grooves of the lock ring, and then, upon still further lowering of the body, force the locking teeth outwardly into locking engagement with the locking grooves and then force the ratchet teeth of the ratchet ring into locking engagement with the ratchet grooves of the locking ring, and upon lowering of the shoulder about the body, and force the upper wedge surface about the body into tight engagement within the wedge surface of the locking ring, as the tapered shoulder about the body is lowered onto the tapered shoulder of the lock ring, and the wedge surface about the body is lowered further downward toward the lower wedge surface of the conductor bore, the wedge surfaces extending at a relatively small angle with respect to the vertical, and the upper wedge surface being coaxial with the lower wedge surfaces.

10. A subsea well apparatus as recited in claim 9, wherein the ratchet ring has a surface slidable downwardly and outwardly over a surface of the body, and the locking ring has a surface slidable upwardly and outwardly over a surface of the conductor bore, as the upper and lower wedge surfaces are tightly engaged; and the first mentioned surfaces forms a larger angle with respect to the horizontal than the second mentioned surfaces, so that the weight of the body urges the rings outwardly.

11. A subsea well apparatus as recited in claim 9, wherein the upper end of the locking ring extends above the conductor and carries bolts for movement inwardly to force the ratchet ring into the recess and thus release its ratchet teeth from the ratchet grooves in the locking ring to permit the locking ring teeth to retract from the grooves in the conductor body, so that the rings may be raised with the body from the conductor bore.

12. A subsea well apparatus as recited in claim 9, wherein the bore of the conductor has a reduced diameter portion beneath its shoulder through which an enlarged portion of the body beneath the seat is guidably passed as the body is lowered; and fluid bypass slots extend vertically through one of the portions.

13. A subsea well apparatus as recited in claim 9, further comprising:

a normally expanded retainer ring supported on the body seat and connected to the lower end of the locking ring for expansion and contraction with respect thereto and upon lowering of the body as forced by the shoulder in the bore to contract to be released prior to the lock ring, but, upon raising of the body to expand for reconnecting with the lock ring and thus retrieval with the body.

14. A subsea well apparatus, comprising:

a conductor having a vertical bore therethrough, locking grooves located in the bore, a shoulder located in the bore, and a lower wedge surface located in the bore below the locking grooves;

a wellhead member body lowerable into the bore of the conductor, having a recess thereabout, an upper wedge surface located below the recess, and a lower wedge surface located below the upper wedge surface for tightly engaging within the lower wedge surface located in the bore of the conductor, a normally contracted split locking ring carried by body and landable on said shoulder in said conductor when body is lowered and having locking teeth thereabout for engaging the locking grooves, an upper wedge surface therein which mates with upper wedge surface on said body when body is landed in said conductor, and ratchet grooves therein above said wedge surface about this locking ring; and a split, normally expanded, ratchet ring positioned in said recess and having ratchet teeth thereabout which engage with ratchet grooves within the locking ring when said body is landed in said conductor.

15. A subsea well apparatus as recited in claim 14, wherein, when said body is landed in said conductor, the body being lowered further with respect to said conductor to cause the tight engagement between the lower wedge surfaces between body and conductor between upper wedge surfaces on the body, and between the locking ring and locking teeth of the locking ring and the locking grooves of conductor.

* * * * *

UNITED STATES PATENT AND TRADEMARK OFFICE

CERTIFICATE OF CORRECTION

PATENT NO. : 6,672,396 B1 
DATED : January 6, 2004
INVENTOR(S) : Daniel A. Marroquin and Flavio Nisenbaum It is certified that error appears in the above-identified patent and that said Letters Patent is hereby corrected as shown below:

Title page,
Insert item:
-- [73] Assignee: Dril-Quip, Inc. --

Signed and Sealed this

Eleventh Day of May, 2004

JON W. DUDAS
*Acting Director of the United States Patent and Trademark Office*